US007431222B2

(12) United States Patent
Monterrosa

(10) Patent No.: US 7,431,222 B2
(45) Date of Patent: Oct. 7, 2008

(54) AEROSOL SPRAY MASKING DEVICE

(76) Inventor: Christopher H. Monterrosa, 4773 Apopo Rd., Kapaa, HI (US) 96746

( * ) Notice: Subject to any disclaimer, the term of this patent is extended or adjusted under 35 U.S.C. 154(b) by 0 days.

(21) Appl. No.: 11/893,798

(22) Filed: Aug. 16, 2007

(65) Prior Publication Data

US 2008/0001006 A1 Jan. 3, 2008

Related U.S. Application Data

(63) Continuation-in-part of application No. 11/421,736, filed on Jun. 1, 2006, now abandoned.

(60) Provisional application No. 60/687,238, filed on Jun. 3, 2005.

(51) Int. Cl.

| | |
|---|---|
| ***B05B 1/28*** | (2006.01) |
| ***B05B 15/04*** | (2006.01) |
| ***B05B 7/32*** | (2006.01) |
| ***B05B 1/26*** | (2006.01) |
| ***B65D 83/28*** | (2006.01) |
| ***B65D 83/14*** | (2006.01) |

(52) U.S. Cl. ..... 239/288.5; 239/288; 239/337; 239/518; 239/120; 222/402.13

(58) Field of Classification Search ..... 239/104, 239/120, 122, 288, 288.3, 288.5, 289, 337, 239/338, 340, 373, 461, 499, 504, 505, 518, 239/589, 600, 601; 222/402.13, 402.12, 222/402.1; 604/300–302

See application file for complete search history.

(56) References Cited

U.S. PATENT DOCUMENTS 3,012,555 A * 12/1961 Meshberg ..... 128/200.23
3,191,867 A * 6/1965 Helms ..... 239/288.5
3,304,797 A 2/1967 Graveley
3,314,426 A 4/1967 Carroll
3,550,857 A * 12/1970 Ahlberg ..... 239/288
3,841,533 A * 10/1974 Carroll et al. ..... 222/402.13
3,887,115 A * 6/1975 Petterson ..... 222/402.13
3,927,806 A * 12/1975 Meshberg ..... 222/402.12
3,935,973 A 2/1976 Weyn
3,935,974 A 2/1976 Weyn
3,935,999 A 2/1976 Weyn
3,936,000 A 2/1976 Weyn (Continued)

*Primary Examiner*—Darren W Gorman
(74) *Attorney, Agent, or Firm*—Craig M. Stainbrook; Stainbrook & Stainbrook, LLP

(57) ABSTRACT

A masking device to prevent over-spray when using an aerosol can to apply aerosols to a work surface. The device includes a horizontal channel structure, the back end of which is essentially open and serves as an insertion point for an aerosol nozzle feed tube from an aerosol can, while the front end serves as an attachment seat for a masking unit. The back end of the horizontal channel is open, providing the user access to the aerosol nozzle in order to actuate the aerosol nozzle with a finger, whereby an aerosol is propelled forward into a masking unit. The masking unit has a small orifice creating a planar opening at the back, and a large orifice creating a generally planar opening at the front The masking unit is essentially hollow, providing the ability to contain an aerosol, the large orifice serving as a mask against a target surface. The masking unit has an observation cut out covered with a transparent film, a vent to exhaust excess pressure and aerosol, and raised beads radiating from the small orifice to the large orifice, which serve as excess aerosol accumulators.

12 Claims, 4 Drawing Sheets

U.S. PATENT DOCUMENTS 4,158,361 A * 6/1979 Kotuby ..... 604/302
4,192,462 A 3/1980 Erickson
4,413,756 A * 11/1983 Kirley ..... 222/402.11
5,344,076 A 9/1994 Mercurio
5,360,165 A * 11/1994 Singhal ..... 239/122
6,113,008 A * 9/2000 Arsenault et al. ..... 239/337
2004/0046049 A1 3/2004 Ricciardelli

* cited by examiner

AEROSOL SPRAY MASKING DEVICE

CROSS REFERENCE TO RELATED APPLICATIONS

The present application is a continuation-in-part patent of U.S. patent application Ser. No. 11/421,736 filed Jun. 1, 2006 (now abandoned), which claims the benefit of the filing date of U.S. Provisional Patent Application Ser. No. 60/687,238, filed Jun. 3, 2005.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates generally to spray masking devices, more particularly to spray masking devices that prevent over-spray phenomenons associated with aerosolized paints, pigments, stains, varnishes and other materials applied by the use of propellants to create an aerosol.

BACKGROUND INFORMATION AND DISCUSSION OF RELATED ART

Aerosolized pigments, paints and varnishes have been in use for many years. A troubling phenomenon associated with aerosolized products from these families is "over-spray". Generally, when an aerosol is created, it is accomplished with the use of a compressed gas or air, or through compression of the subject fluid. In many professional spray apparatuses, pressurized air is released across an aperture, creating a venturi effect, drawing the fluid from a reservoir through a small aperture which then disperses the fluid in tiny droplets. Alternatively, the fluid may be pressurized by the use of a pump. The fluid is then passed through a small aperture that may contain a needle valve that disperses the fluid. In each case, the spray created by the droplets conforms to a pattern, usually heavier in the center of the pattern and lighter on the edges of the pattern. This lighter portion of the pattern is generally composed of smaller droplets that may be carried by circulating air currents or currents created by the actual force of the spray from the area of focus to other areas that are not intended to be sprayed. In order to control the dispersion of the droplets in the spray pattern, devices have been developed to control the over-spray effect. Traditionally, the control of the over-spray effect has been achieved through masking the area outside of the intended application area with adhesive tape and paper combinations or through the use of aerosol spray focusing apparatus.

U.S. Patent Application Pub. No. US 2004/0046049 A1, to Ricciardelli teaches an over-spray shield that fits on an aerosol can to prevent excess spray from escaping during the spraying. The device is intended primarily for use by fisherman spraying artificial fishing flies with scent or floatant. However, it does not include a viewing window or a pressure release vent.

U.S. Pat. No. 3,314,426, to Carroll, shows an eyecup and spray dispenser adapted to confine aerosolized medications sprayed into the eye. In dimension it is obviously quite small. It does not include either the viewing window or the pressure release vent.

U.S. Pat. No. 3,304,797, to Gravely, teaches an actuating device for aerosol cans, but it also shows a funnel adapted to confine the spray output in a small field. Again, it does not include a viewing window or release vent.

U.S. Pat. No. 5,344,076, to Mercurio, shows a hair spray cone exhaust which snaps onto cans of aerosol hair spray. It limits application of hair spray to the hair of a person and limits the release of fumes into the surrounding atmosphere. The inclusion of a window would be unneeded, and the use of a release vent would be contrary to the purpose of the invention.

U.S. Pat. Nos. 3,935,999; 3,936,000; 3,935,973 and 3,935,974, to Weyn Tech, teach over-spray shields that are attached to spray cans in a vertical manner. Only one of the disclosures shows a dispenser permitting finger access to the spray button, and none show a viewing window or release vent.

U.S. Pat. No. 4,192,462, to Erickson, teaches a transparent overs-pray shield that would allow viewing while spraying plaster, paint, varnish, etc. The apparatus includes a truncated housing defining a pyramidal spray chamber. The housing has a large planar open end defined by the forward edges of housing sidewalls. A spray gun is attached such that its spray nozzle is disposed through rear opening in the rear center of the housing. The housing includes a number of vent openings covered by filter. Accordingly, while comprising a significantly different geometry and purpose, this device does include the window and release vent omitted in the other disclosures, however it does not describe a utility for an aerosol can activated by a finger.

It is an object of the present invention to provide an over-spray shield for products in aerosol cans that combines the utility of a viewing window.

It is a further object of the present invention to provide an over-spray shield with a venting means to prevent pressure build up that additionally functions as an accumulator for excess aerosol.

It is still a further object of the present invention to provide an over-spray shield with a means for channeling the excess material from the over-spray into a reservoir.

It is yet a further object of the present invention to provide an over-spray shield that allows access for the operator's finger to actuate the spray nozzle on an aerosol can.

The foregoing patents and prior art devices reflect the current state of the art of which the present inventor is aware. Reference to, and discussion of, these patents is intended to aid in discharging Applicant's acknowledged duty of candor in disclosing information that may be relevant to the examination of prospective claims to the present invention. However, it is respectfully submitted that none of the above-indicated patents disclose, teach, suggest, show, or otherwise render obvious, either singly or when considered in combination, the invention described herein.

BRIEF SUMMARY OF THE INVENTION

The present invention is a masking device to prevent over-spray when using an aerosol can to apply paint, stains or finishes to a work surface. Additionally, the present invention may be used to apply any aerosolized product to a surface, such as herbicides or insecticides to a specific area, or to apply disinfectants to a surface to be sterilized such as the dermis of a surgical patient.

The device is comprised of a horizontal channel structure, having a bottom, a left side and a right side, a back end and a front end. The back end of the channel is essentially open, while the front end serves as an attachment seat for a masking unit. The bottom of the horizontal channel has an aperture approximately one third of the distance to the front of the horizontal channel. The aperture serves as an opening through which an aerosol dispersion nozzle feed tube from an aerosol can may be inserted. Once the aerosol dispersion nozzle feed tube is inserted into the aperture, the aerosol dispersion nozzle may be affixed to the aerosol nozzle feed tube, securing the aerosol can to the horizontal channel. The back end of the horizontal channel is open, providing the user access to the aerosol nozzle in order to actuate the aerosol nozzle with a finger.

A masking unit has a front, a back, a small orifice creating a planar opening at the back, and a large orifice creating a planar opening at the front, and top, a bottom, an interior surface and an exterior surface. The masking unit may take a variety of shapes, including a cone shape, a half sphere or a pyramidal shape, depending on the masking application. The masking unit is essentially hollow, providing the ability to contain an aerosol. The masking unit may be constructed of a resilient plastic or resin material, or of a light weight rigid material such as aluminum. The small orifice represents the back of the masking unit which is attached reversibly to the front of the horizontal channel. The small orifice may alternatively be integrally attached to the front of the horizontal channel. The small orifice also serves as the entry aperture through which an aerosol is passed through the masking unit to the large orifice. The large orifice provides the masking ability when placed against a work surface. The top of the masking unit has a cross sectional opening representing approximately one third of the height and width of the masking unit which is fitted with a replaceable transparent film that is utilized as a viewing port to observe the progress of work being performed. The large orifice at the front of the masking unit serves as a contact area between the work surface and the masking unit. The perimeter of the large orifice of the masking unit has a raised bead that protrudes toward the inward circumference of the masking unit. This bead creates a separation between the work surface and the exterior circumference of the masking unit and serves as a reservoir for material created by excess aerosol droplets, preventing transfer of the material created by excess aerosol droplets to the work surface. The masking unit interior surface also has a plurality of raised product accumulators which are essentially raised lines radiating from the small orifice of the masking unit to the raised bead that protrudes toward the inward circumference of the masking unit. These product accumulators trap the over-spray particles and direct the particle to the raised bead accumulator on the circumference of the large orifice of the masking unit. A plurality of slits that form an essentially rectangular vent are located at the bottom perimeter of the masking unit large orifice acting to prevent aerosol pressure build up when the masking unit is in contact with a work surface. In addition, the rectangular vent serves as a secondary accumulator for collected excess material from overspray.

BRIEF DESCRIPTION OF THE SEVERAL VIEWS OF THE DRAWINGS

The invention will be better understood and objects other than those set forth above will become apparent when consideration is given to the following detailed description thereof. Such description makes reference to the annexed drawing wherein:

FIG. 1B is a perspective view showing the horizontal channel with a masking unit disposed immediately above it and poised for insertion into the retention tab, while

DRAWING REFERENCE NUMERALS

Figure 1:
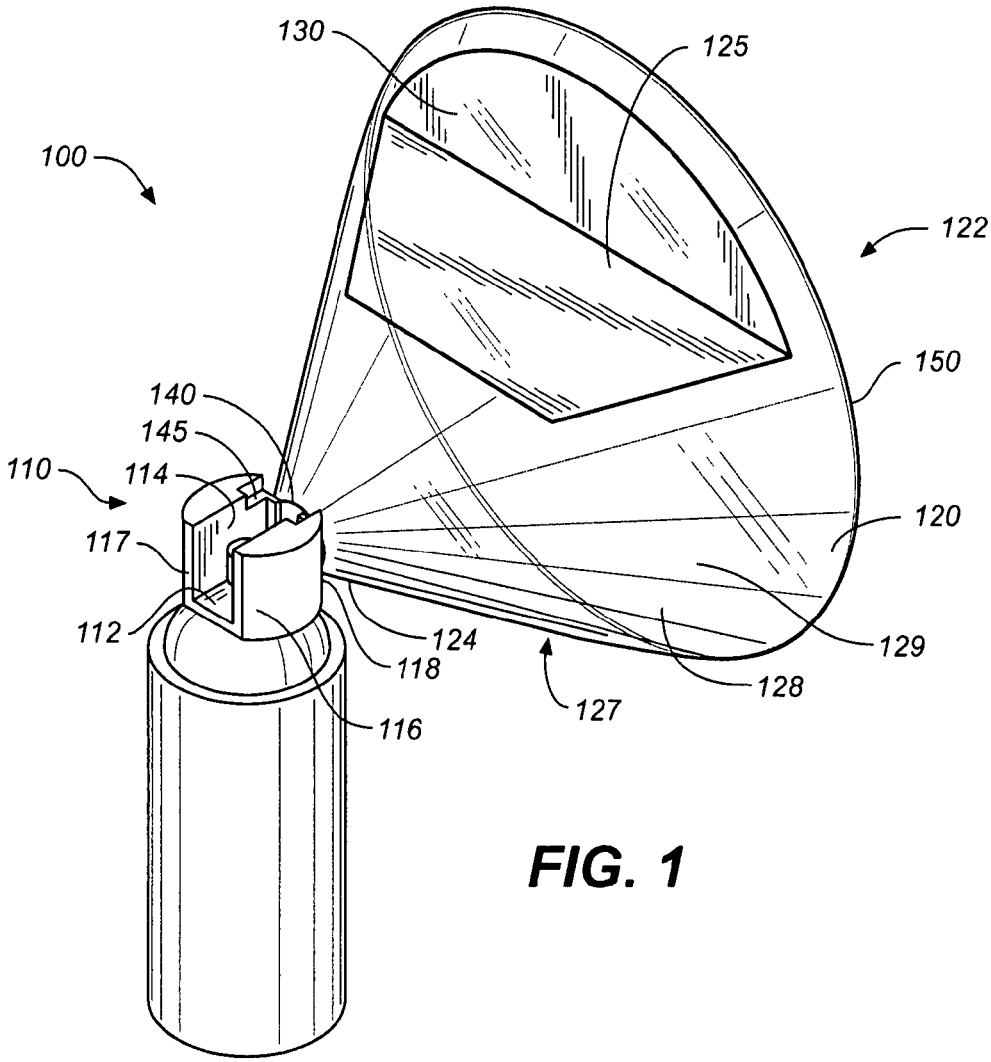
FIG. 1 is a perspective view of the aerosol spray masking device with an aerosol can attached.

100 aerosol spray masking device
110 horizontal channel
112 horizontal channel bottom
114 horizontal channel left side
116 horizontal channel right side
117 horizontal channel back end
118 horizontal channel front end
120 masking unit
122 masking unit front
124 masking unit back
125 observation cut-out
126 masking unit top
127 masking unit bottom
128 interior surface
129 exterior surface
130 transparent film
140 small orifice
141 aerosol nozzle feed tube aperture
145 attachment means
146 retention tab
148 retention ring
150 large orifice
200 product accumulators
210 aerosol nozzle
220 raised bead
230 vent

DETAILED DESCRIPTION OF THE INVENTION

Referring to FIGS. 1 through 4, wherein like reference numerals refer to like components in the various views, there is illustrated therein a new and improved aerosol spray masking device, generally denominated 100 herein.

FIG. 1 illustrates a preferred embodiment of the aerosol spray masking device 100, comprising a horizontal channel 110, having a horizontal channel bottom 112, a horizontal channel left side 114 and a horizontal channel right side 116, a horizontal channel back end 117 and a horizontal channel front end 118. A masking unit 120 having a masking unit front 122 and a masking unit back 124, a small orifice 140 and a large orifice 150 which share an axis, and masking unit top 126 and a masking unit bottom 127, and an interior surface 128 and an exterior surface 129. Also depicted is an observation cut-out 125 with a replaceable transparent film 130 that is utilized as a viewing port to observe the progress of work being performed. An attachment means 145 for the masking unit 120 is located proximally to the horizontal channel front end 118.

Figure 1A:
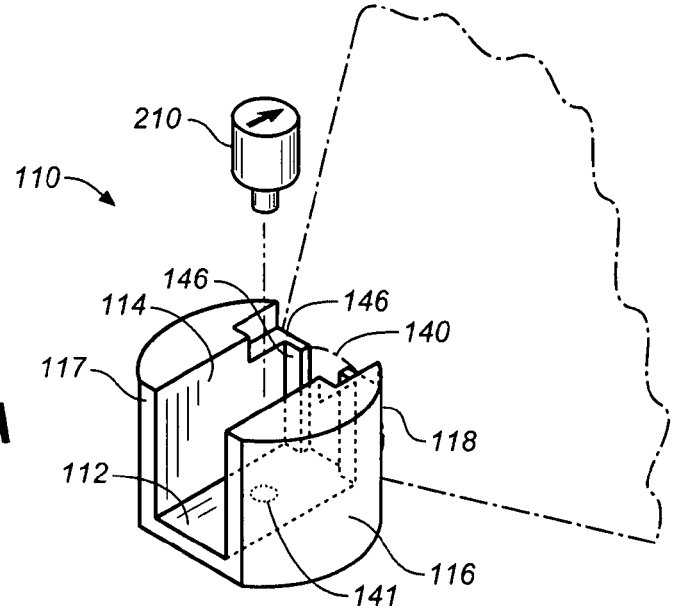
FIG. 1A is a detailed perspective view showing the horizontal channel of the aerosol spray masking device.
Figure 1B:
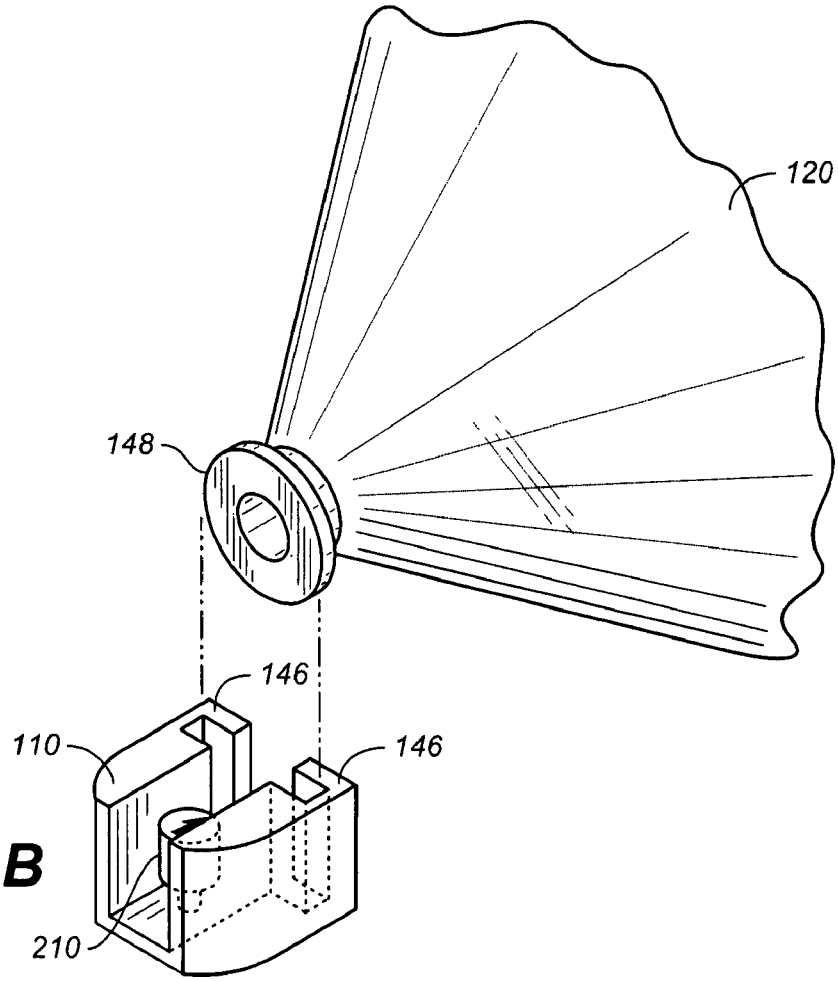
Figure 1C:
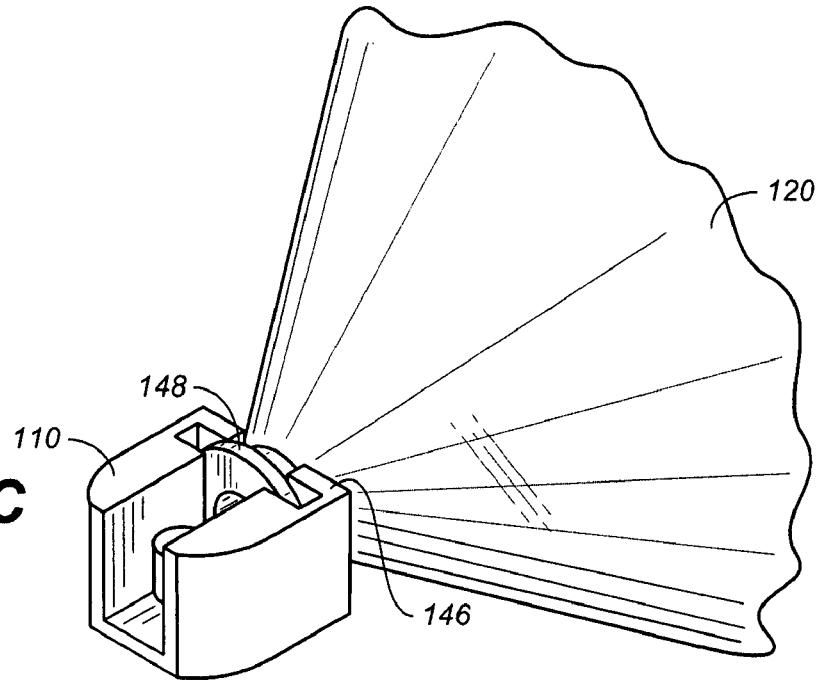
FIG. 1C is a prespective view showing the masking unit with a retention ring inserted into the retention tab.

FIGS. 1A-1C depict the horizontal channel 110 with an attachment means 145 which utilizes a medially protruding retention tab 146, positioned perpendicular to the plane of the horizontal channel left side 114, and repeated identically on the horizontal channel right side 116. An annular retention ring 148 protrudes in a planar fashion from the rim of the small orifice 140. The annular retention ring 148 may be slidably inserted into or slidably removed from the retention tab 146 of the attachment means 145. Also depicted is the aerosol nozzle feed tube aperture 141 positioned in the horizontal channel bottom 112.

Figure 2:
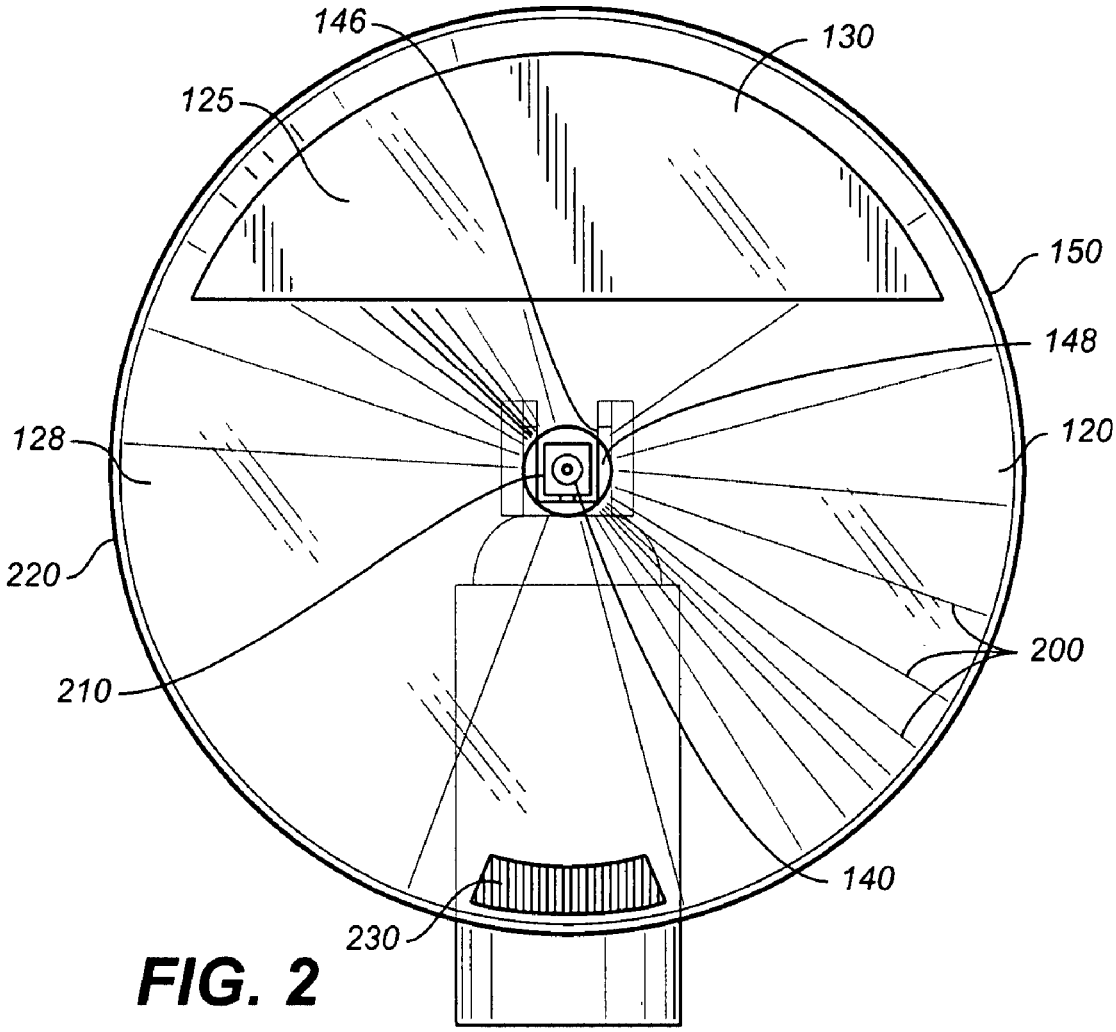
FIG. 2 is a front view of the aerosol spray masking device, showing the interior of the masking unit.

FIG. 2 is a front view of the masking unit 120, showing the observation cut-out 125 with the transparent film 130. The interior surface 128 of the masking unit 120 exhibits a plurality of raised product accumulators 200 radiating from the small orifice 140 to the large orifice 150 of the masking unit

120. The perimeter of large orifice 150 of the masking unit has a raised bead 220 that serves as an accumulator for excess material, prevents transfer of the over-spray to the work surface and creates a masking seal against a work surface. An aerosol nozzle 210 is centrally located in the small orifice 140. Located near the bottom edge of the masking unit 120, on the perimeter of the Large orifice 150, is a plurality of slits that form an essentially rectangular vent 230 acting to prevent aerosol pressure build up when the masking unit is in contact with a work surface. Additionally, the rectangular vent 230 serves as a secondary accumulator for collected excess material from over-spray.

Figure 3:
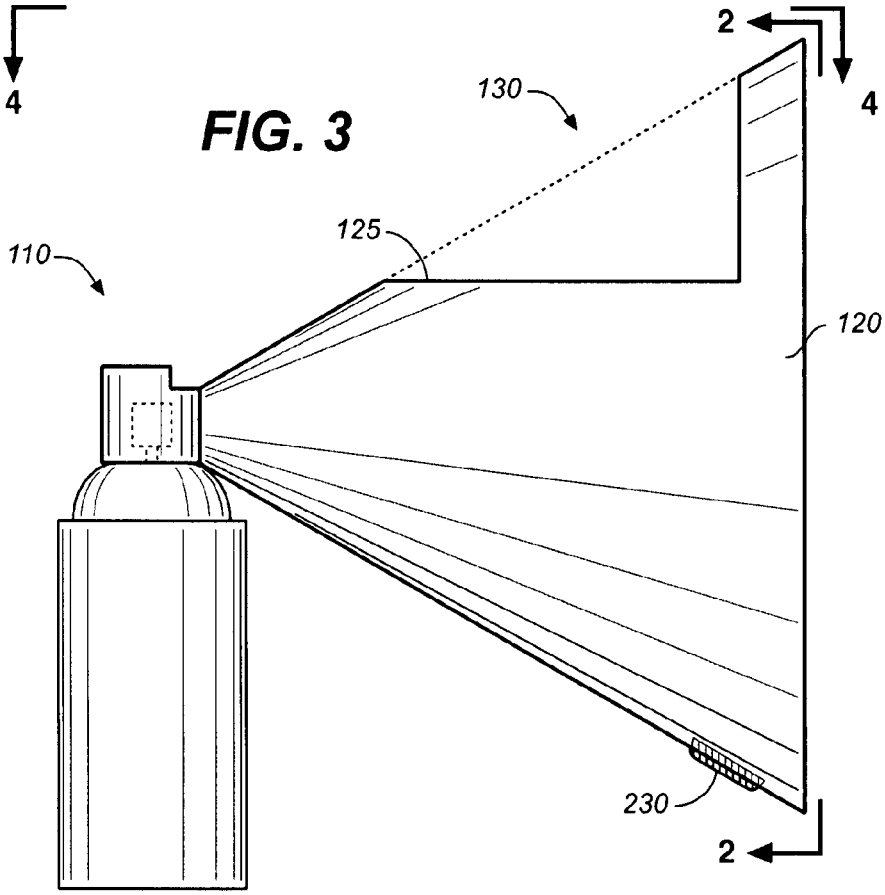
FIG. 3 is a side view of second preferred embodiment of the aerosol spray masking device with an aerosol can attached.

FIG. 3 is a side view of second preferred embodiment of the aerosol spray masking device 100 with an aerosol can attached. The horizontal channel 110 is depicted integrally attached to the masking unit 120. The rectangular vent 230 and the observation cut-out 125 with the transparent film 130 are also depicted in the illustration.

Figure 4:
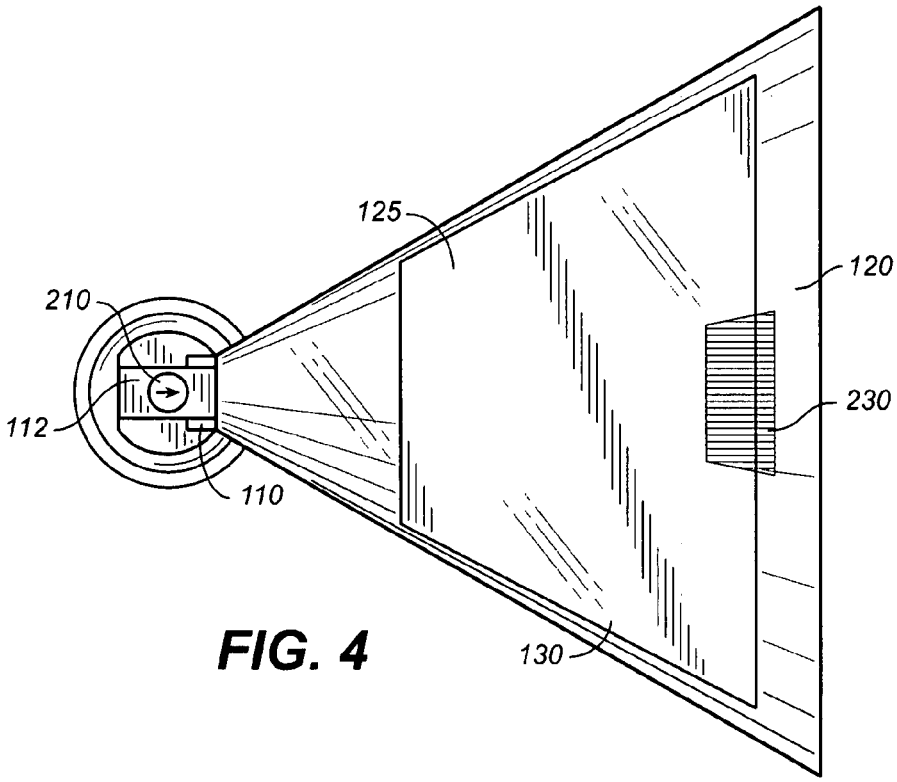
FIG. 4 is a top down view of the aerosol spray masking device showing the masking unit small orifice integrally attached to the horizontal channel.

FIG. 4 is a top down plan view of the aerosol spray masking device showing the masking unit small orifice integrally attached to the horizontal channel. Illustrated is the horizontal channel 110 and an aerosol nozzle 210 positioned in the horizontal channel bottom 112. Also depicted are the rectangular vent 230, the observation cut-out 125 and the transparent film 130 and their respective positions on the masking unit 120.

While the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Accordingly, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the foregoing Abstract provide at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which is measured by the claims only, nor is it intended to be limiting as to the scope of the invention in any way.

What is claimed as invention is:

1. An aerosol spray masking device comprising:

a substantially hollow masking unit for containing an aerosol, said masking unit having a front and a back, a first orifice defining a rear opening and a second orifice defining a front opening, a top and a bottom, an interior surface and an exterior surface, a cross sectional opening in the top of said masking unit, and at least one vent for exhaust of pressure and aerosol;

a plurality of raised product accumulators radiating from said first orifice to said second orifice on said interior surface of said masking unit;

a transparent film covering said cross sectional opening in said masking unit;

a horizontal channel having a back end, a front end and a bottom; and an aerosol dispersion nozzle feed tube aperture in said bottom of said horizontal channel for insertion of an aerosol dispersion nozzle feed tube.

2. The aerosol spray masking device of claim 1, wherein said masking unit is substantially essentially cone shaped.

3. The aerosol spray masking device of claim 1, wherein said second orifice of said masking unit has a raised bead defining an interior rim of said large orifice, providing an accumulation reservoir for excess aerosol.

4. The aerosol spray masking device of claim 1, wherein said at least one vent comprises a plurality of slits in said masking unit.

5. The aerosol spray masking device of claim 1, wherein at least one vent is located proximally to said second orifice of said masking unit.

6. The aerosol spray masking device of claim 1, wherein said back end is open so as to provide access for a user's finger to actuate an aerosol dispersion nozzle attached to said aerosol dispersion nozzle feed tube.

7. An aerosol spray masking device comprising:

a substantially hollow masking unit for containing an aerosol, said masking unit having a front and a back, a first orifice defining a rear opening and a second orifice defining a front opening, said first orifice and second orifice sharing an axis, a top and a bottom, an interior surface and an exterior surface, a cross sectional opening in the top of said masking unit, and at least one vent for exhaust of pressure and aerosol;

said rear opening having an annular retention ring extending in a planar fashion, perpendicular to said axis, a plurality of raised product accumulators radiating from said first orifice to said second orifice on said interior surface of said masking unit;

a transparent film covering said cross sectional opening in said masking unit;

a horizontal channel having a back end, a front end and a bottom, a left side and a right side;

an attachment means on said front of said horizontal channel having retention tabs medially protruding from said left side and said right side; and, an aerosol dispersion nozzle feed tube aperture in said bottom of said horizontal channel for insertion of an aerosol dispersion nozzle feed tube.

8. The aerosol masking device of claim 7, wherein said annular retention ring slidably attaches to and detaches from said retention tabs on said attachment means.

9. The aerosol spray masking device of claim 8, wherein said second orifice of said masking unit has a raised bead defining an interior rim of said large orifice, providing an accumulation reservoir for excess aerosol.

10. The aerosol spray masking device of claim 7, wherein said at least one vent comprises a plurality of slits in said masking unit.

11. The aerosol spray masking device of claim 7, wherein at least one said vent is located proximally to said second orifice of said masking unit.

12. The aerosol spray masking device of claim 7, wherein said back end is open so as to provide access for a user's finger to actuate an aerosol dispersion nozzle attached to said aerosol dispersion nozzle feed tube.

* * * * *